US007224762B2

(12) United States Patent
Koger

(10) Patent No.: US 7,224,762 B2
(45) Date of Patent: May 29, 2007

(54) COUNTING DEVICE

(76) Inventor: Marion M. Koger, 1200 Interstate Pkwy., Augusta, GA (US) 30909

( * ) Notice: Subject to any disclaimer, the term of this patent is extended or adjusted under 35 U.S.C. 154(b) by 114 days.

(21) Appl. No.: 11/068,462

(22) Filed: Feb. 23, 2005

(65) Prior Publication Data

US 2006/0188057 A1 Aug. 24, 2006

(51) Int. Cl.
*G06M 11/00* (2006.01)

(52) U.S. Cl. ..... 377/6; 377/3

(58) Field of Classification Search ..... None
See application file for complete search history.

(56) References Cited

U.S. PATENT DOCUMENTS 3,808,692 A * 5/1974 Gartner ..... 33/759
4,417,351 A * 11/1983 Williamson et al. ..... 377/8
4,833,697 A * 5/1989 Perna et al. ..... 377/15
5,457,312 A * 10/1995 Mansour ..... 250/222.2
6,683,321 B2 * 1/2004 Livingston et al. .... 250/559.47
2002/0186807 A1 * 12/2002 Kozak ..... 377/8

* cited by examiner

*Primary Examiner*—Tuan T. Lam
(74) *Attorney, Agent, or Firm*—Sara A. Centioni; Nexsen Pruet, LLC

(57) ABSTRACT

A counting device that can be employed in calculating the number of objects, such as cigarette packs. In particular, the counting device can include a handle portion and a counting portion. The handle portion includes a display for showing the number of objects counted. The counting portion includes means for delineating the boundaries of the objects being counted and means for counting the objects that overlaps or abuts to the delineating means. Further, the counting device includes a control for turning the device on or off, and for clearing previous counting steps.

18 Claims, 5 Drawing Sheets

COUNTING DEVICE

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

The present invention relates generally to counting devices, and, in particular, to electronic counting devices.

In retail stores, employees typically work in isolated or back-to-back shifts. For example, an employee working for a convenience store or a gas stop will typically work a morning shift, and then turn over responsibility to another employee for the afternoon or night shifts. A time consuming duty of an employee beginning a shift at such an establishment includes the taking of inventory of such goods as cigarettes. In particular, the employee must account for the number of cigarette packs and cartons he or she begins the shift with, so that any potential inconsistencies in numbers between shifts can be avoided. If inventory were not taken, the burden of accounting for missing goods that were not sold as evidenced by a receipt would fall on the last employee to take a shift. Therefore, an inventory-taking system must be in place in such stores to avoid the potential for employee theft.

Traditional methods for taking inventory include counting by hand or employing a calculator and thereafter recording the totals. Whereas these methods are sufficient to accomplish the task of taking inventory, mistakes can occur in calculating the goods. Accordingly, employees typically perform the task multiple times for accuracy. Further, these methods are not particularly fast. Therefore, performing them multiple times makes the task of taking inventory both time consuming and tedious.

Accordingly, there exists a need for a convenient and efficient device for taking inventory of goods.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

According to its major aspects and briefly stated, the present invention includes In operation, the device can be placed over the objects needing to be counted. The delineating means of the device is then aligned with the outer boundaries of the objects so that the first object in an array of objects is in line with the end of the counting portion. Finally, the counting means is activated at the location of the last object in the array of objects. These steps are repeated until all of the objects are counted. The total number of objects counted will be displayed on the handle portion until either the device is turned off or the display is cleared.

A feature of the present invention is the use of a counting device including the combination of a delineating means and counting means. This feature eliminates and/or improves upon traditional steps employed in taking inventory thereby providing enhanced efficiency and accuracy. In the past, taking inventory in stores included the manual counting of a number of objects and the recording of the results from the manual counting. To avoid errors, the entire group of objects needing to be counted was divided into smaller groups, and manual counting was typically done on each of the smaller groups. Next, the sums of the number of objects from the smaller groups were added to produce a total number of objects. Depending on the number of objects, traditional calculators were also employed. However, these steps still produced inaccuracies considering the potential for human error. Not only can the eyes of one taking inventory skip over an object in an array of objects, but also errors can be made in both recording information, as well as inputting information into a calculator. In the present invention, the delineating means alleviates the need for manually counting and visualizing each object. As long as the objects are placed into an orderly array that is synchronized with the delineating means, the counting device accounts for all of the objects within the array. Furthermore, there is no need to record separate sums from distinct arrays in order to calculate a total number because the counting means can automatically add the number of objects in each array as a user continues to activate the counting means.

Another feature of the present invention is the use of a delineating means that can include protuberances along the counting portion of the device so that the device can be utilized at various angles and heights without having to sacrifice the accuracy of the counting process. For example, if the user has to count an array of objects that is on the top of a series of shelves, the protuberances of the delineating means can facilitate the user in assessing at which point along the counting portion the counting means should be activated.

Other features and advantages of the present invention will be apparent to those skilled in the art from a careful reading of the Detailed Disclosure of the Preferred Embodiments presented below and accompanied by the drawings.

DETAILED DESCRIPTION OF THE PREFERRED EMBODIMENTS

Figure 1:
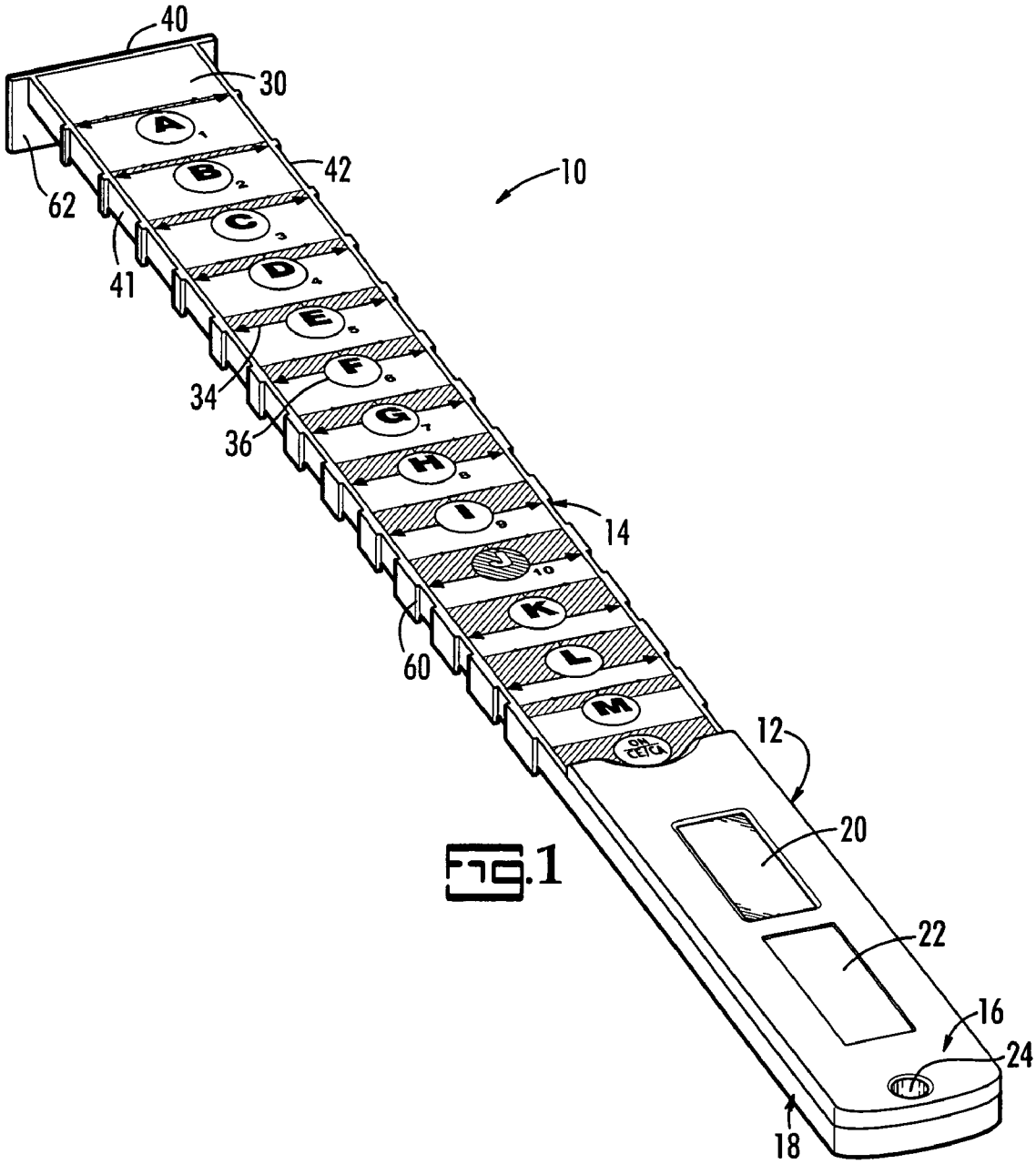
FIG. 1 illustrates a perspective view of a counting device according to a preferred embodiment of the present invention.
Figure 2:
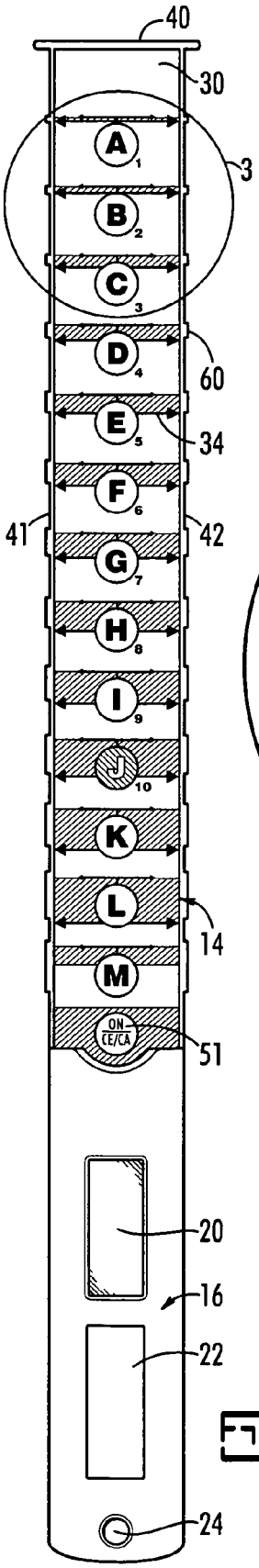
FIG. 2 illustrates a top view of a counting device according to a preferred embodiment of the present invention.
Figure 3:
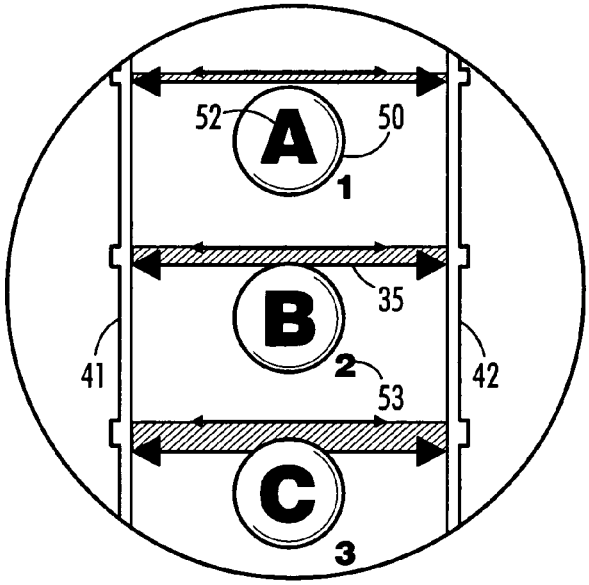
FIG. 3 illustrates an detailed top view of a counting device according to a preferred embodiment of the present invention.
Figure 4:
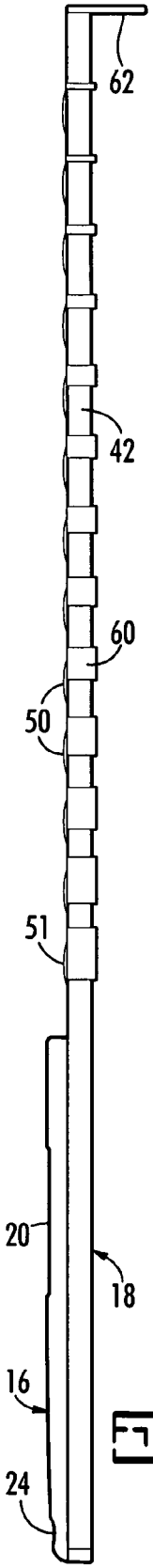
FIG. 4 illustrates a side view of a counting device according to a preferred embodiment of the present invention.
Figure 5:
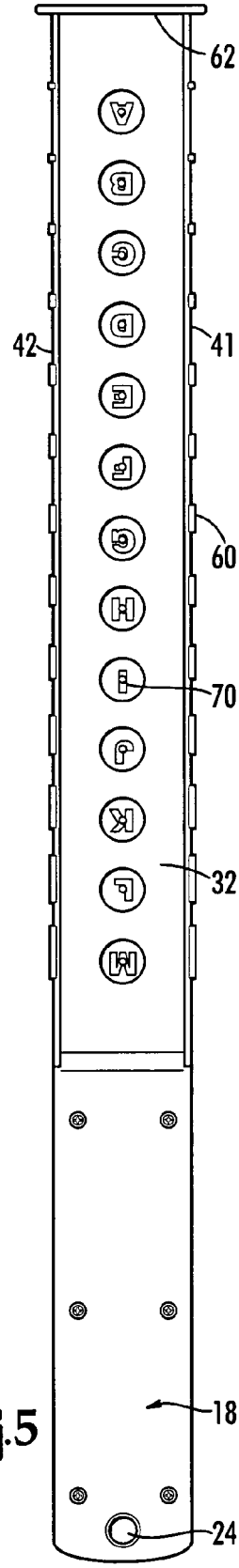
FIG. 5 illustrates a bottom view of a counting device according to a preferred embodiment of the present invention.

As illustrated in FIGS. 1–5, the present invention includes a counting device 10 having a handle portion 12 and a counting portion 14. The handle portion 12 can include a face 16, a rear wall 18, and an interior (not illustrated) that can house the electrical components for providing the functions of the present invention. The electrical components utilized can include standard electronic features that would allow the counting device to function and display the results. As further shown, the face 16 of the handle portion 12 can include a display screen 20, such as an LCD screen, which has the ability to display numbers up to about 4 digits. Optionally, the face 16 can include an area 22 for placing indicia, such as a logo used in connection with the counting device 10. Further, the handle portion can include an aperture 24 that can be employed in the storing the counting device 10.

The counting portion 14 can include a top surface 30, a bottom surface 32, a top edge 40, a first side edge 41, a second side edge 42, and an interior (not illustrated) that can house any additional electrical components needed for providing the functions of the present invention. Along the top surface 30 can be included means for delineating 34 the boundaries of the objects being counted and means for counting 36 the objects that is associated with the delineating means 34. As shown in detail in FIG. 3, the delineating means 34 can include a series of primary marks, such as large straight arrows 35, that extend laterally from the first side edge 41 to the second side edge 42 of the counting portion 14 and that are evenly spaced along the top surface 30 of the counting portion 14. These primary marks can delineate the outer boundaries of whatever object needs to be counted. Depending on the size and dimensions of a particular object, the spacing of the primary marks can be modified. For example, the space between two primary marks can delineate the outer boundaries of a pack of regular cigarettes. Optionally, a series of secondary marks, such as small straight arrows 37, can also be included along the top surface 30. For example, the spacing between two secondary marks can delineate the outer boundaries of a pack of slim cigarettes. It is contemplated that multiple marks designating the boundaries of various sized objects can be employed in the present invention.

The counting means 36 can include a series of buttons 50 that each correspond to a number that is equal to the number of objects located between the top edge 40 of the counting portion 14 and the button. Of course, the farther removed the particular button of the series of buttons 50 is from the top edge 40, the higher the number corresponding to that button. Each button of the series of buttons 50 can include primary indicia, such as letters 52, that show an incremental increase from the first button of the series 50 to the last button of the series 50. Once depressed, the buttons will activate the counting means 36, which will display the number of objects counted based on the particular button of the series of buttons 50 that is pushed. Although a variety of electronic means can be employed, the device can contain an electronic, digital calculator, which is well known in the art, having an "add" capability only, wherein its input is the series of buttons 50 and its output is the display screen 20. For example, pressing the "C" button inputs a "3" to the calculator and outputs a "3" on the display screen 20. Thereafter, pressing the "D" button inputs a "4" and adds the "4" to the "3" in the calculator register so that the output displays the sum, namely, a "7." Optionally, the display screen 20 can include up to four digits, as well as the current primary indicia. For example, if the last button pressed is a "D" which adds "4" to a previous sum of 9990, the display screen 20 would have the capability of showing "D9994."

At the end of the series of buttons 50 can be included a control button 51 for use in both turning the device on or off, and in clearing the display screen 20. If the device 10 is accidentally left on, a timer (not shown) can also be included that will automatically turn off the device 10 so as to conserve energy. Preferably, the number last displayed on the screen 20 will continue to show even after the device 10 is turned off and on again until the screen 20 is cleared so that a user will not lose count in the case the device 10 is accidentally turned off.

Optionally, the counting means can include secondary indicia, such as small numbers 53, that can be located next to the series of buttons 50. In the case that the primary indicia includes letters 52, the use of numbers 53 as secondary indicia can assist a user in adding objects whose boundaries are not delineated by either the primary or secondary marks of the delineating means 34. For example, in the case that inventory needs to be taken of packs of cigarettes that are contained by cartons, the dimension of which are not delineated, a user can manually count the cartons, and then push the button next to the small number 53 that corresponds to the number of packs of cigarettes within each carton. For example, if each carton contains 10 packs of cigarettes, a user will push the button next to the small number "10," which corresponds to the letter "J," three times so that the output displays "30," or the total number of packs of cigarettes. If the carton contains 5 packs instead of 10, then the button next to the smaller number "5" will be pushed the number of times equal to the number of cartons counted.

As discussed, a feature of the present invention is the use of the combination of the delineating means 34 and the counting means 36. This feature eliminates and/or improves upon traditional steps employed in taking inventory thereby providing enhanced efficiency and accuracy. In the present invention, the delineating means 34 alleviates the need for manually counting and visualizing each object. As long as the objects are placed into an orderly array that is synchronized with the delineating means 34, the counting device 10 accounts for all of the objects within the array. Furthermore, there is no need to record separate sums from distinct arrays in order to calculate a total number because the counting means 36 can automatically add the number of objects in each array as a user continues to activate the counting means 36.

As further illustrated in the figures, the counting portion 14 can include additional features that assist in the operation of the counting device 10. Along the first side edge 41 and the second edge 42 can be included a series of side projections 60. These side projections 60 can be aligned with the delineating means 34 so that a user need not be able to see the delineating means 34 in order to press the correct button for counting. For example, if an array of objects is located on an elevated shelf, the user of the device 10 can be guided by the side projections 60 through feel to the correct button without having to view the top surface of the device 10 in the process. In the case that the delineating means 34 includes both primary and secondary marks, the projections 60 can approximately span the width between the primary and secondary marks located at each button so that the projections can aid in the counting of objects of differing dimensions. The bottom surface 32 of the counting portion 14 can also include a series of bottom projections 70 that indicate the location of the series of buttons 50 along the top surface 30. Again, such bottom projections 70 enable a user to press the correct button during the counting process without also having to view the top surface 30 of the device 10. Not only do these features provide flexibility to the use of the device 10, they may also assist employees that are physically disabled, such as visually impaired, in performing such tasks.

Additionally, the top edge 40 can include a flange 62 that extend perpendicularly from the top surface 30 of the counting portion 14. As shown, the flange 62 can extend beyond the bottom surface 32 so that the flange 62 can engage the first object of an array of objects to initiate the counting process.

Figure 6A:
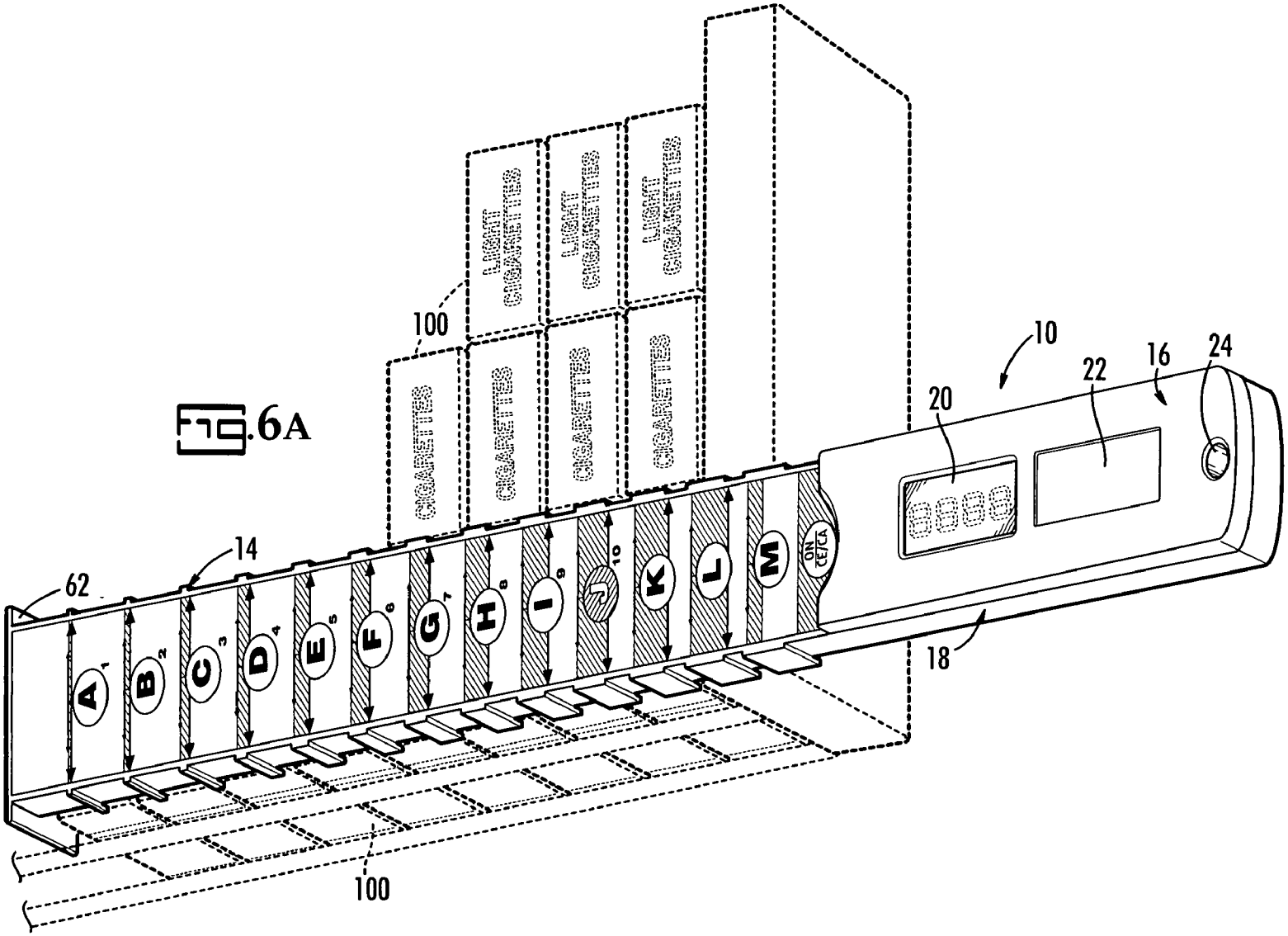
FIG. 6A illustrates a perspective view of a counting device in operation according to a preferred embodiment of the present invention.
Figure 6B:
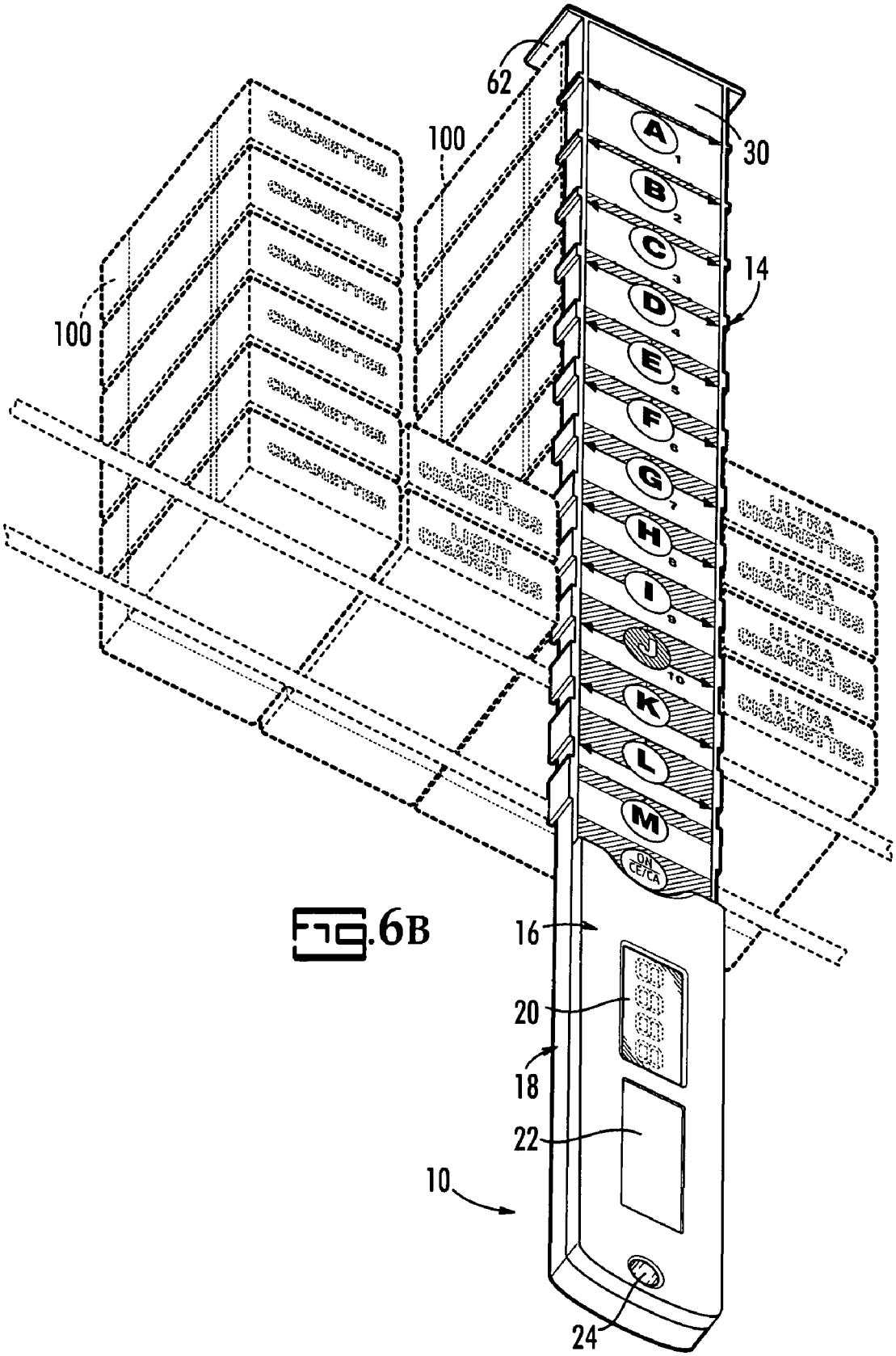
FIG. 6B illustrates a perspective view of a counting device in operation according to a preferred embodiment of the present invention.

FIGS. 6A and 6B illustrate the counting device 10 in use. For exemplary purposes only, the device 10 is being shown as used in counting an inventory of cigarette packs. However, it is contemplated that a variety of different objects can also be counted by employing the present invention. In operation, the device 10 can be placed over an array of objects needing to be counted, such as a row of cigarette packs 100. The first object in the array of objects is then engaged by the flange 62 50 that the boundaries of the array of objects become synchronized with the primary or secondary marks of the delineating means 34. Once the array of objects is appropriately engaged by the device, the user presses the button along the series of buttons 50 that corresponds to the last object of the array of object. As shown in FIG. 6B, because the boundaries last object of the array of objects are in line with the primary marks of the delineating means 34 corresponding to the button labeled "J," the "J" button would be pressed by a user. These steps are repeated until all of the arrays of objects are counted. Once counting is completed, the total number of objects counted will be displayed on the display screen 20.

What is claimed is:

1. A counting device, comprising:

a handle portion; and a counting portion connected to said handle portion and having means for delineating and means for counting, wherein said delineating means includes a series of primary marks that designate the outer boundaries of each object in an array of objects, wherein said counting means is connected to said delineating means such that said counting means calculates the total number of objects in said array of objects, wherein said counting portion includes a top edge, wherein said top edge includes a flange dimensioned to engage the first object of said array of objects, wherein said counting means includes a series of buttons that are associated with said series of primary marks, and wherein each button of said series of buttons corresponds to a different number of objects in said array of objects between said flange and said each button.

2. The counting device as recited in claim 1, wherein said handle portion includes a display screen that is in operative connection with said counting means.

3. The counting device as recited in claim 1, wherein said counting portion includes side edges having projections, and wherein said projections are aligned with said delineating means.

4. The counting device as recited in claim 1, wherein said counting portion includes a bottom surface having projections, and wherein said projections are aligned with said counting means.

5. The counting device as recited in claim 1, wherein said delineating means includes a series of secondary marks.

6. The counting device as recited in claim 1, wherein said counting means includes a series of buttons that are labeled by primary indicia, and wherein said primary indicia are letters.

7. The counting device as recited in claim 6, wherein said counting means includes secondary indicia that is be located next to said series of buttons, and wherein said secondary indicia are numbers.

8. The counting device as recited in claim 1, further comprising a control button that is located on said counting portion.

9. A method for counting an array of objects, comprising:

providing a counting device, comprising:

a handle portion; and a counting portion that is connected to said handle portion and having means for delineating and means for counting, wherein said delineating means includes a series of primary marks that designate the outer boundaries of each object in an array of objects, and wherein said counting means is connected to said delineating means such that said counting means calculates the total number of objects in said array of objects;

placing said counting device over an array of objects needing to be counted;

engaging the first object in said array of objects with said counting portion so that the boundaries of said array of objects is aligned with said primary marks of said delineating means; and activating said counting means so that all of the objects in said array of objects are calculated.

10. The method as recited in claim 9, wherein said handle portion includes a display screen in operational connection with said counting means.

11. The counting device as recited in claim 9, wherein said counting portion includes a top edge, and wherein said top edge includes a flange dimensioned to engage the first object of said array of objects.

12. The counting device as recited in claim 11, wherein said counting means includes a series of buttons that are associated with said series of primary marks, and wherein each button of said series of buttons corresponds to a different number of objects in said array of objects that is between said flange and said each button.

13. The counting device as recited in claim 9, wherein said counting portion includes side edges having projections, and wherein said projections are aligned with said delineating means.

14. The counting device as recited in claim 9, wherein said counting portion includes a bottom surface having projections, and wherein said projections are aligned with said counting means.

15. The counting device as recited in claim 9, wherein said delineating means includes a series of secondary marks.

16. The counting device as recited in claim 9, wherein said counting means includes a series of buttons that are labeled by primary indicia, and wherein said primary indicia are letters.

17. The counting device as recited in claim 16, wherein said counting means includes secondary indicia that is be located next to said series of buttons, and wherein said secondary indicia are numbers.

18. The counting device as recited in claim 9, further comprising a control button that is located on said counting portion.

* * * * *